US005943830A

United States Patent [19]

Truitt

[11] Patent Number: 5,943,830

[45] Date of Patent: Aug. 31, 1999

[54] KNEE BRACE BRACKET FOR TILT-UP CONSTRUCTION

[75] Inventor: Robert E. Truitt, Carson, Calif.

[73] Assignee: Dayton Superior Corporation, Miamisburg, Ohio

[21] Appl. No.: 09/084,544

[22] Filed: May 26, 1998

Related U.S. Application Data

[60] Provisional application No. 60/048,092, May 30, 1997.

[51] Int. Cl.[6] ..... E04G 25/00; E04H 12/20

[52] U.S. Cl. ..... 52/127.2; 52/126.3; 248/351; 248/354.1; 269/904; 254/133 A

[58] Field of Search ..... 52/127.2, 126.3, 52/149, 150, 151; 248/351, 354.1; 269/43, 904; 254/133 A

[56] References Cited

U.S. PATENT DOCUMENTS

| | | | |
|---|---|---|---|
| 1,221,481 | 4/1917 | Selway . | |
| 1,316,096 | 9/1919 | James . | |
| 3,462,896 | 8/1969 | Lokensgaard | 52/127.2 |
| 3,574,981 | 4/1971 | Henschen . | |
| 3,798,856 | 3/1974 | Gloskowski . | |
| 3,805,463 | 4/1974 | Lang et al. . | |
| 3,920,232 | 11/1975 | Clark | 269/43 |
| 4,068,427 | 1/1978 | Camardo . | |
| 4,075,913 | 2/1978 | Tye . | |
| 4,083,156 | 4/1978 | Tye . | |
| 4,268,066 | 5/1981 | Davis | 280/763 |
| 4,304,078 | 12/1981 | Meriwether, Jr. . | |
| 4,872,634 | 10/1989 | Gillaspy et al. . | |
| 4,890,473 | 1/1990 | Westerman | 269/43 X |
| 4,934,673 | 6/1990 | Bahler | 269/43 |

FOREIGN PATENT DOCUMENTS

| | | | |
|---|---|---|---|
| 168543 | 9/1959 | Sweden | 249/354.1 |
| 218810 | 2/1968 | Sweden | 52/127.2 |

OTHER PUBLICATIONS

Dayton Superior, "Tilt–up Construction Handbook", 1990, pp. 42–44.

*Primary Examiner*—Robert Canfield
*Attorney, Agent, or Firm*—Biebel & French

[57] ABSTRACT

A knee brace bracket for use in a knee bracing system for tilt-up panel constructions. The knee brace bracket includes front and rear face members defining circular structures for extending around a main pipe brace which extends between a panel and a floor slab. The knee brace bracket is rigidly connected to a knee brace extending to a connection point on the panel. The knee brace bracket includes a plurality of rollers engaged with the main pipe brace whereby the main pipe brace is permitted to rotate within the knee brace bracket to permit a screw adjustment for the length of the main pipe brace.

14 Claims, 2 Drawing Sheets

KNEE BRACE BRACKET FOR TILT-UP CONSTRUCTION

PRIOR PROVISIONAL APPLICATION

Applicant claims the benefit of the filing date of Provisional application Ser. No. 60/048,092, filed May 30, 1997.

BACKGROUND OF THE INVENTION

This invention relates generally to braces for use in tilt-up construction and, more particularly, to a knee brace bracket for use in a bracing structure for tilt-up construction wherein the knee brace bracket permits adjustment of the bracing structure to facilitate vertical alignment of a braced panel.

During construction using tilt-up panels, a brace structure is commonly provided to maintain the panels in a vertical position during construction, and prior to completion of the structure. One type of bracing structure comprises a tilt-up pipe brace having a foot plate for attachment to a floor surface and a wall plate for attachment to the wall surface, and an adjustable pipe member extending between the plates wherein the vertical orientation of the panel may be adjusted through adjustment of the pipe member length.

In addition to providing the above described bracing structure, a knee brace is also provided extending from a midpoint of the pipe member to a location on the panel, and is oriented generally perpendicular to the pipe member. In prior art constructions, the knee brace has been connected to the pipe member by means of a coupler or bracket wherein means are provided for clamping the bracket to both the knee brace and the pipe member to thereby rigidly connect the two members together. Further, the coupler for the knee brace is typically attached to a portion of the pipe member which is adapted to be rotated relative to a screw portion of the pipe member for adjustment of the pipe member length. Accordingly, in the past it has been difficult to adjust the vertical alignment of tilt-up panels after connection of the knee brace to the pipe member, since such an adjustment requires releasing the knee brace coupler from the pipe member, necessitating the use of a crane to hold the tilt-up panel during such an adjustment.

Therefore, there is a need for a tilt-up construction bracing structure which permits adjustment of the bracing structure to facilitate alignment of a tilt-up panel. There is a further need for such a bracing structure wherein the structure is capable of providing bracing support to the panel during adjustment of the structure.

SUMMARY OF THE INVENTION

The present invention provides a knee bracing system and, more particularly, a knee brace bracket which is adapted to be attached to the end of a knee brace and which rotatably engages a pipe member defining a main brace extending between a tilt-up panel and a floor slab. The knee brace bracket includes a bracket frame pivotally supported on a socket member having a socket opening for receiving the end of a knee brace.

The bracket frame is defined by four semicircular side frames wherein two of the side frames form a front face member for the bracket frame and the other two side frames form a rear face member for the bracket frame. Four rollers are rotatably supported between the front and rear faces of the bracket frame wherein the rollers include surfaces for engaging the main brace whereby the main brace may be rotated relative to the bracket frame for adjustment of the length of the main brace.

Therefore, it is an object of the invention to provide a knee brace bracket which provides a connection between a main brace and a knee brace.

It is a further object of the invention to provide a knee brace bracket wherein the brace is adapted to rigidly hold the knee brace and main brace in engagement with each other while permitting rotation of the main brace.

Other objects and advantages of the invention will be apparent from the following description, the accompanying drawings and the appended claims.

DETAILED DESCRIPTION OF THE PREFERRED EMBODIMENT

Figure 1:
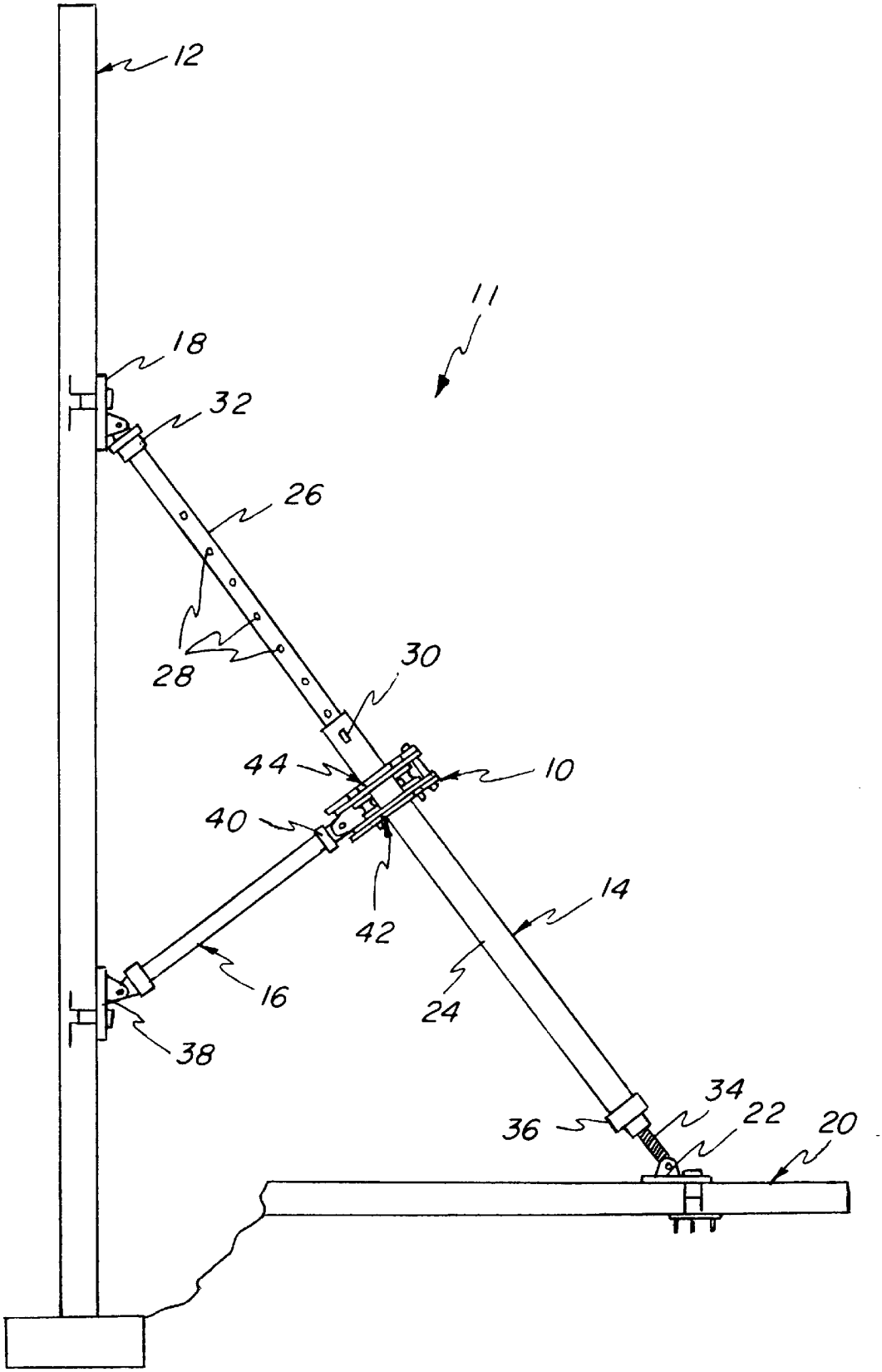
FIG. 1 is a side elevational view showing the knee brace bracket in use connecting a knee brace to a main brace for supporting a tilt-up panel.

Referring to FIG. 1, the present invention provides a knee brace bracket 10 comprising part of a knee bracing system 11 for use in erection of tilt-up panels 12. The bracket 10 is adapted to attach to a pipe member or main brace 14, and to a knee brace 16. In tilt-up constructions, the main brace 14 is typically pivotally attached to the panel 12 at a wall plate 18, and is pivotally attached to a floor slab 20 at a foot plate 22. Specifically, the main brace 14 includes a first pipe 24, and a second pipe 26 received in telescoping relationship within the first pipe 24. The second pipe 26 is provided with a plurality of apertures 28 which are engaged by a pin 30 extending through an aperture in the first pipe 24 to generally align the pipes 24, 26 to the appropriate overall length.

The second pipe 26 is attached to the wall plate 18 through a ball bearing coupler 32 to thereby permit rotation of the main brace 14 relative to the wall plate 18. In addition, the first pipe 24 is attached to the foot plate 22 through an adjusting screw 34 threadably engaged with a lower end 36 of the first pipe 24. Thus, rotation of the main brace 14 will cause adjustment of the length of the brace 14 between the wall plate 18 and foot plate 22 in order to obtain the desired vertical alignment of the panel 12.

The knee brace 16 is attached to the panel 12 at a further wall plate 38 located below the wall plate 18, and the knee brace 16 extends from the wall plate 38 to the main brace 14 at an angle of approximately 90° relative to the main brace 14. The knee brace 16 is rigidly attached to the knee brace bracket 10 at a socket member 40.

Figure 3:
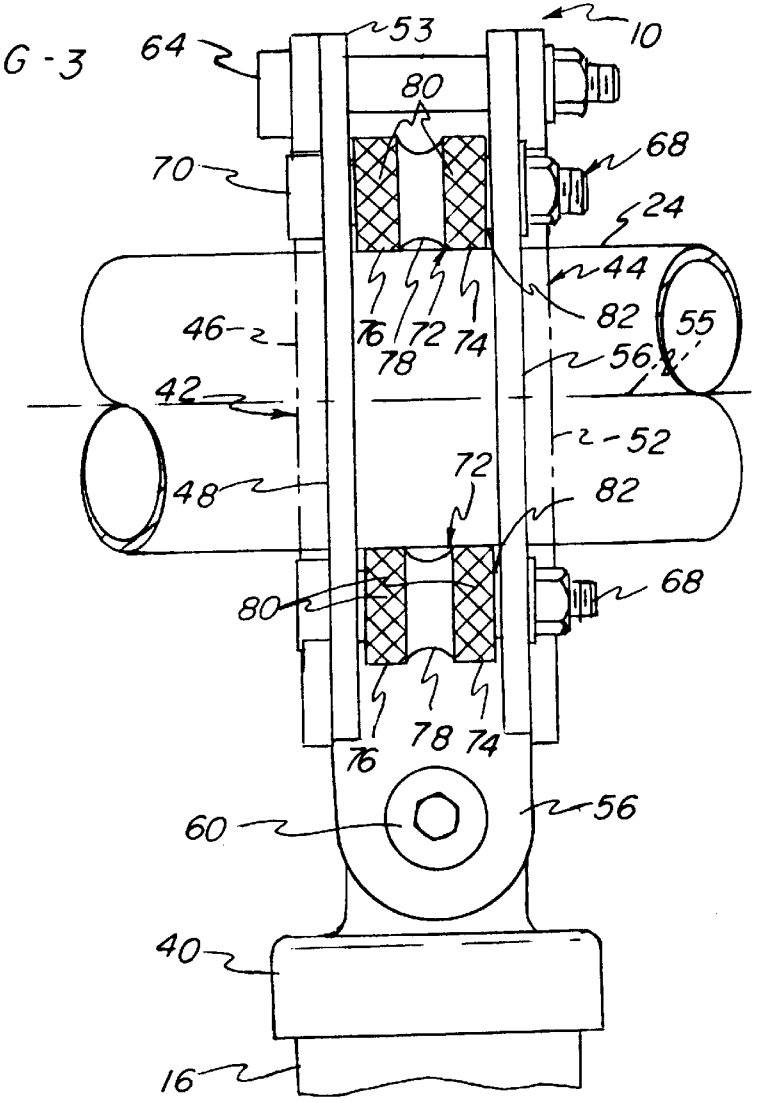
FIG. 3 is a side elevational view thereof.
Figure 2:
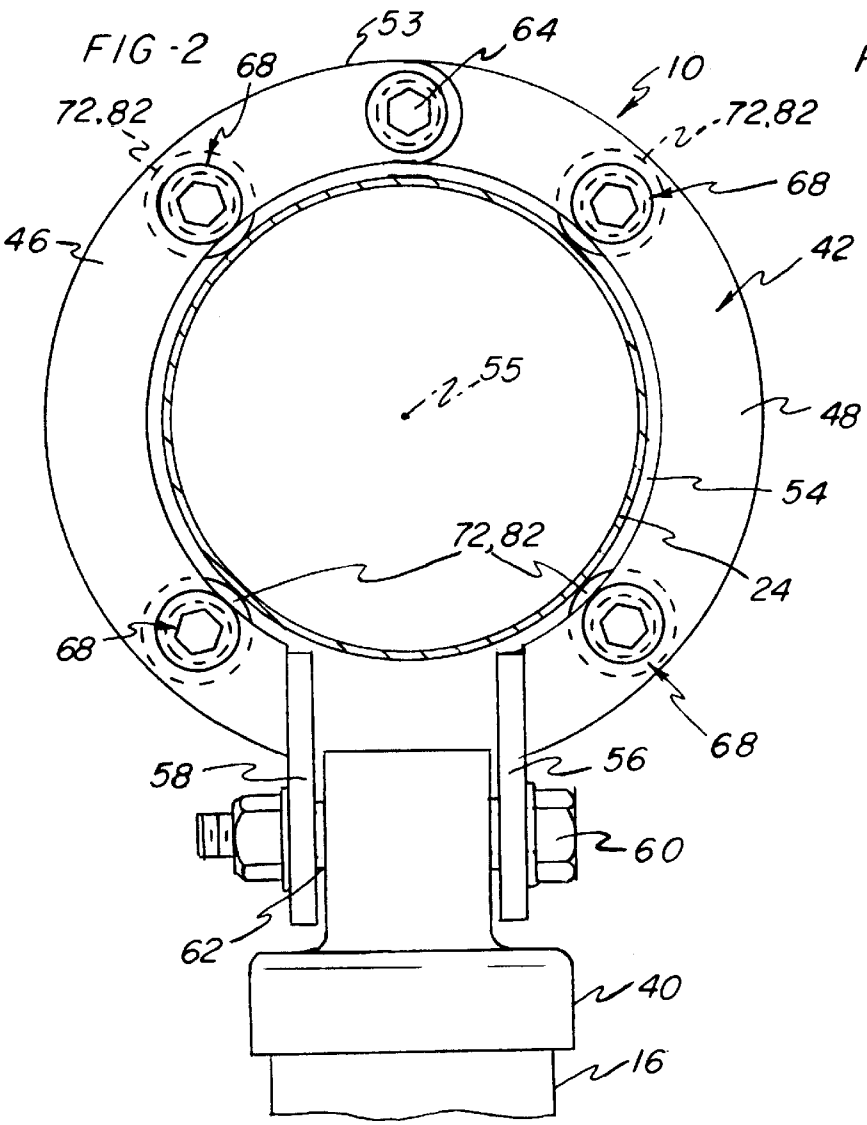
FIG. 2 is a front elevational view of the knee brace bracket of the present invention.

Referring to FIGS. 2 and 3, the knee brace bracket 10 comprises a front face member 42 and rear face member 44 wherein the front and rear face members are formed of identical constructions. The front face member 42 is formed of first and second identical, semicircular side frames 46, 48, and the rear face member 44 is similarly formed by identical, third and fourth semicircular side frames 50, 52. The side frames 46, 48 and 50, 52 define a bracket frame 53 having a circular passage 54 for receiving the first pipe 24 of the main brace 14. The passage 54 defines a longitudinal axis 55 coaxial with the longitudinal axis of the main brace 14.

The side frames 46, 48 and 50, 52 are each attached to connector plates 56, 58 by welding, or an equivalent attachment means. The connector plates are pivotally attached to the socket member 40 by means of a bolt 60 and spacer sleeve 62 which permits pivotal movement of the side frames 46, 48, 50, 52 relative to the socket member 40 about an axis defined by the bolt 60. In addition, an opposite end of the side frames 46, 48 and 50, 52 is attached to each other by a shoulder bolt 64. The shoulder bolt 64 provides a pivot between the pairs of side frames 46, 48 and 50, 52.

A plurality of roller structures 68 are provided in generally equally spaced circumferential relation around the longitudinal axis 55 of the passage 54. The roller structures 68 extend between the front and rear face members 42, 44 around the periphery of the bracket 10. Each of the roller structures 68 include a bolt 70 rotatably supporting a roller 72 for rotational movement relative to the bracket frame 53. In addition, each roller 72 includes engagement surfaces 74, 76 separated by a groove 78. The engagement surfaces 74, 76 of the rollers 72 extend into the circular passage 54 for engagement with the first pipe 24 of the main brace 14.

Rotational movement of the rollers 72 permit rotation of the first pipe 24 relative to the knee brace bracket 10. The engagement surfaces 74, 76 simultaneously restrict movement of the knee brace bracket 10 along the longitudinal axis 55 relative to the main brace 14. In addition, it should be noted that the engagement surfaces 74, 76 may be provided with a knurled or other friction inducing surface 80 in order to further limit longitudinal movement of the knee brace bracket 10 along the length of the first pipe 24. Additionally, a spacer sleeve 82, around the bolts 68 between the side frames 50, 52 and rollers 72, provides the function of maintaining the spacing between the front and rear face members 42, 44 around the circumference of the bracket 10.

In operation, the bolt 60 may be separated from the bracket 10 to permit the side frames 46, 48, 50, 52 to pivot relative to each other such that the engagement surfaces 74, 76 of the rollers 72 are moved outwardly away from the longitudinal axis 55 thereby facilitating placement of the bracket 10 around the first pipe 24 of the main brace 14. The connector plates 56, 58 are then attached to the socket member 40 by means of the bolt 60 whereby the knee brace bracket 10 is positively engaged around the main brace 14 to complete the assembly of the knee bracing system 11 for supporting a tilt-up panel 12.

Should the user desire to adjust the vertical alignment of the panel 12, the main brace 14 may be rotated such that the adjusting screw 34 extends thereby lengthening the main brace 14 extending between the wall plate 18 and foot plate 22. As the first pipe 24 of the main brace 14 is rotated, the rollers 72 of the knee brace bracket 10 likewise rotate, while the engagement surfaces 74, 76 prevent movement of the knee brace bracket 10 longitudinally along the first pipe 24. As such, the knee brace bracket 10 remains in engagement with the main brace 14 during vertical adjustment of the tilt-up panel 12 for assisting in the support thereof.

It should be apparent from the above description that the present invention provides an attachment bracket which allows a panel contractor to construct a temporary support for a tilt-up panel without requiring a crane to hold the panel in its desired vertical position. In addition, the present invention allows the panel's position to be adjusted without compromising safety.

A further benefit of the present knee brace bracket is that the bracing may be adjusted as needed after detachment of the panel from the crane. Also, the crane may be released from the panel during the initial panel erection phase earlier than prior art fixed, rigid bracing systems would permit. Thus, the present invention facilitates a reduction in the overall erection time and cost for placement of tilt-up panels.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A knee brace bracket for connecting a main brace to a knee brace, said knee brace bracket comprising:

a frame including a passage for receiving a main brace, said passage defining a longitudinal axis;

at least one engagement surface supported by said frame and extending into said passage, said at least one engagement surface adapted for engaging the main brace;

at least one connector attached to said frame for supporting the knee brace; and wherein said at least one engagement surface is adapted for facilitating relative rotation between the main brace and said frame while simultaneously preventing relative movement between the main brace and said frame in a direction parallel to said longitudinal axis.

2. The knee brace bracket of claim 1 wherein said at least one engagement surface is adapted to be selectively moveable relative to said frame thereby facilitating said relative rotation between the main brace and said frame.

3. The knee brace bracket of claim 1 wherein said at least one engagement surface includes a friction inducing surface for restricting movement of said frame along said longitudinal axis.

4. The knee brace bracket of claim 1 further comprising:

a plurality of rollers rotatably supported by said flame, each of said plurality of rollers circumferentially spaced around said longitudinal axis; and wherein said at least one engagement surface comprises a plurality of engagement surfaces defined by said plurality of rollers.

5. The knee brace bracket of claim 1 wherein said frame comprises first and second side frames, each of said first and second side frames including opposing ends, one of said opposing ends of said first side frame pivotally connected to one of said opposing ends of said second side frame whereby said at least one engagement surface may be selectively moved outwardly away from said longitudinal axis.

6. The knee brace bracket of claim 5 wherein:

said frame further comprises third and fourth side frames in spaced relation along said longitudinal axis to said first and second side frames;

each of said third and fourth side frames includes opposing ends, one of said opposing ends of said third side frame pivotally connected to one of said opposing ends of said fourth side frame whereby said at least one engagement surface may be selectively moved outwardly away from said longitudinal axis; and said first and second side frames define a front face member and said third and fourth side frames define a rear face member.

7. The knee brace bracket of claim 6 further comprising:

a plurality of rollers rotatably supported between said front and rear face members and circumferentially space around said longitudinal axis; and wherein said at least one engagement surface comprises a plurality of engagement surfaces defined by said plurality of rotatable rollers.

8. A knee bracing system for use in tilt-up construction, said knee bracing system comprising:

a knee brace bracket including a frame having a passage, said passage defining a longitudinal axis;

a main brace including a first pipe rotatably supported within said passage of said knee brace bracket, wherein said knee brace bracket is restricted from moving along said longitudinal axis relative to said first pipe; and a knee brace connected to said frame of said knee brace bracket and disposed substantially perpendicular to said main brace.

9. The knee bracing system of claim 8 wherein said knee brace is pivotally connected to said frame of said knee brace bracket.

10. The knee bracing system of claim 8 wherein said main brace has a length, said length being adjustable through rotation of said first pipe.

11. The knee bracing system of claim 10 wherein said main brace further comprises a second pipe received in telescoping relationship within said first pipe.

12. The knee bracing system of claim 8 wherein:

said knee brace bracket further comprises a plurality of rollers rotatably supported by said frame, each of said plurality of rollers circumferentially spaced around said longitudinal axis; and each of said plurality of rollers includes an engagement surface extending into said passage for engaging said first pipe.

13. The knee bracing system of claim 12 wherein:

said frame of said knee brace bracket further comprises first and second side frames, each of said first and second side frames having opposing ends, one of said opposing ends of said first side frame pivotally connected to one of said opposing ends of said second side frame whereby said engagement surface of each said roller may selectively engage said first pipe.

14. A knee brace bracket for connecting a main brace to a knee brace, said knee brace bracket comprising:

a frame including a passage for receiving a main brace, said passage defining a longitudinal axis;

at least one engagement surface supported by said frame and extending into said passage, said at least one engagement surface adapted for engaging the main brace;

said frame further including first and second side frames, each of said first and second side frames including opposing ends, one of said opposing ends of said first side frame pivotally connected to one of said opposing ends of said second side frame whereby said at least one engagement surface may be selectively moved outwardly away from said longitudinal axis;

said frame further including third and fourth side frames in spaced relation along said longitudinal axis to said first and second side frames, each of said third and fourth side frames including opposing ends, one of said opposing ends of said third side frame pivotally connected to one of said opposing ends of said fourth side frame whereby said at least one engagement surface may be selectively moved outwardly away from said longitudinal axis;

a front face member defined by said first and second side frames;

a rear face member defined by said third and fourth side frames; and wherein said at least one engagement surface is adapted for facilitating relative rotation between the main brace and said frame.

* * * * *

UNITED STATES PATENT AND TRADEMARK OFFICE

CERTIFICATE OF CORRECTION

PATENT NO. : 5,943,830

DATED : August 31, 1999

INVENTOR(S) : Robert E. Truitt

It is certified that error appears in the above-indentified patent and that said Letters Patent is hereby corrected as shown below:

In claim 4, at line 2, replace "flame" with --frame--.

Signed and Sealed this

Fourteenth Day of March, 2000

*Attest:*

Q. TODD DICKINSON

*Attesting Officer*

*Commissioner of Patents and Trademarks*